United States Patent [19]

Sjogren

[11] Patent Number: 4,583,381

[45] Date of Patent: Apr. 22, 1986

[54] ROTARY DOOR AND WINDOW LOCK

[75] Inventor: C. Norman Sjogren, San Gabriel, Calif.

[73] Assignee: Belwith International, Ltd., City of Industry, Calif.

[21] Appl. No.: 568,723

[22] Filed: Jan. 9, 1984

[51] Int. Cl.[4] ..... E05B 65/08

[52] U.S. Cl. ..... 70/95; 70/100; 70/134; 70/380; 70/DIG. 80; 292/142

[58] Field of Search ..... 70/95, 99, 100, 134, 70/368, 379, 380, DIG. 20, DIG. 80; 292/39, 142, 172, 174, DIG. 37

[56] References Cited

U.S. PATENT DOCUMENTS

| | | | |
|---|---|---|---|
| 1,964,066 | 6/1934 | Kuszmaul | 292/172 X |
| 2,264,962 | 12/1941 | Adams | 292/147 |
| 2,707,385 | 5/1955 | Fisler | 70/380 X |
| 2,934,370 | 4/1960 | Love et al. | 292/142 |
| 3,514,979 | 6/1970 | Wiesmann | 292/172 X |
| 4,009,599 | 3/1977 | Patriquin | 70/360 X |
| 4,163,375 | 8/1979 | Fujitaki | 70/360 X |

*Primary Examiner*—Robert L. Wolfe
*Attorney, Agent, or Firm*—Robert R. Thornton

[57] ABSTRACT

A compact push-pull right-angle lock especially suited for use on patio doors and on windows has a cylindrical bolt with rack teeth on its central section, a barrel lock assembly, and a rotatable disk all contained in a horizontally split case. The bolt can be extended in either direction by the right angled linear motion of the barrel lock assembly. Linear motion of the barrel lock assembly is transferred to linear motion of the bolt through a disk that is free to rotate some fifty degrees about a shaft. The barrel lock assembly is loosely linked to a crank pin set perpendicularly to the plane of the disk and the bolt rack is meshed with an arcuate section of a pinion gear on the disk located some ninety degrees from the crank pin. The bolt can be locked in either extended position by means of a cam lug which cna be moved from the barrel lock assembly housing into locking recesses in the case by rotational movement of the keyed barrel lock. Means are also provided for replacement of the barrel lock when necessary.

6 Claims, 7 Drawing Figures

14
18
12
16
28
20
10
25
96
94
80
32
22
78
30
24
44
34
90
42
40
36
92
38
86
84
62
46
48
58
50
56
76
74
60
46A
48A
26
54
76A
52
74A
30
72
70
68
64
66

FIG. 3.
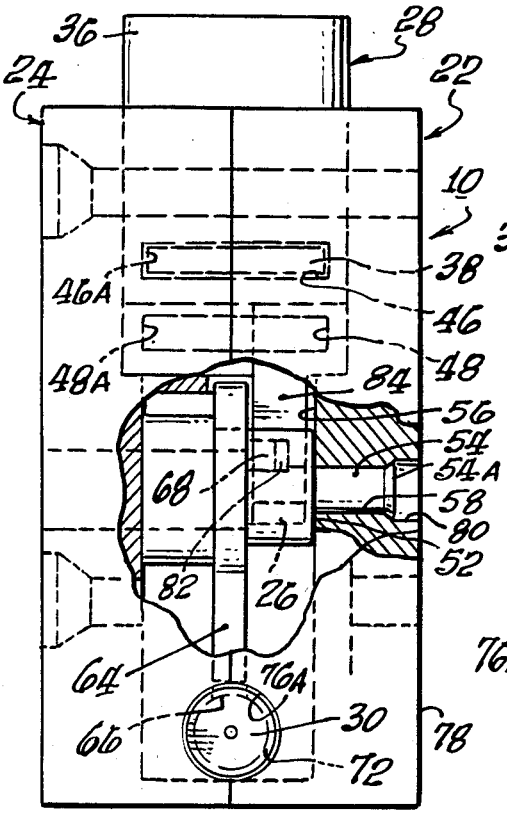
FIG. 4.
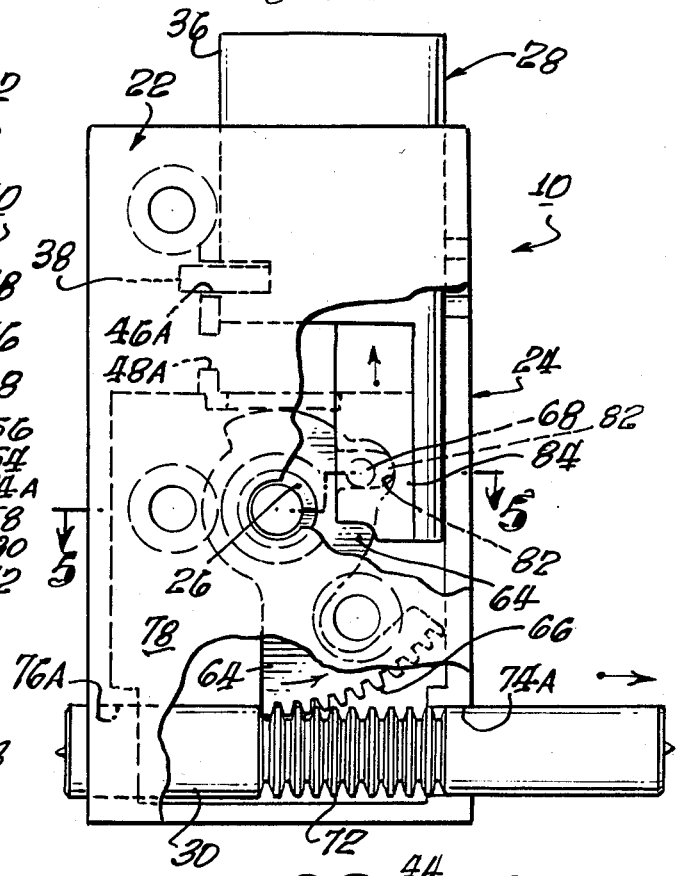
FIG. 5.
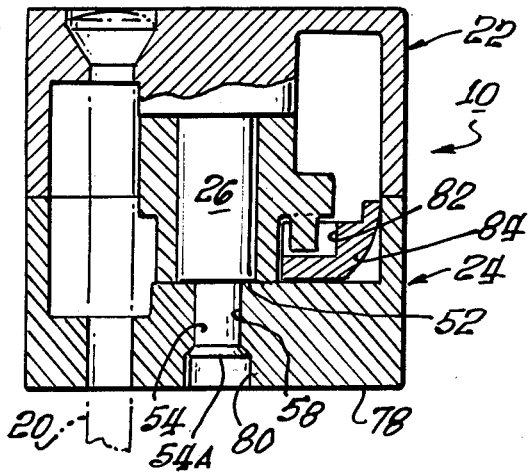
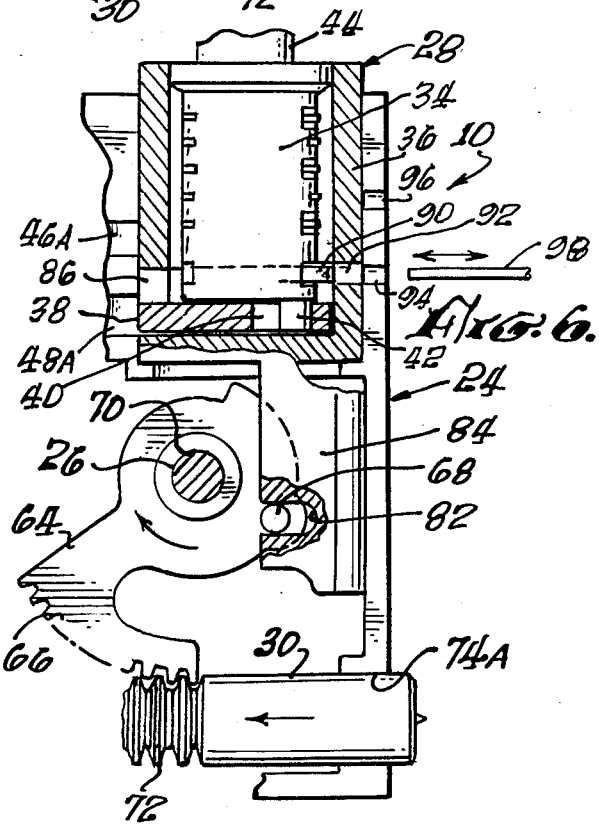
FIG. 6.
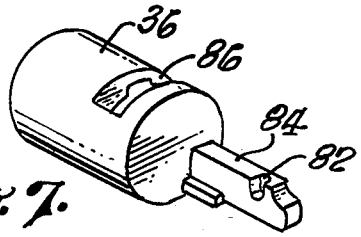
FIG. 7.

ROTARY DOOR AND WINDOW LOCK

BACKGROUND OF THE INVENTION

The need for keyed right-angle locks for doors and windows is well established. The size of such locks must be kept small to fit the dimensions of mounting surfaces. These constraints determine to a great degree the applicable mechanism.

The use of rack and pinion gears to change rotary motion to linear motion, and vice versa, is well known. The use of two such systems to produce reciprocating motion at right angles is also well known and has been described for example in U.S. Pat. Nos. 1,195,881; 1,251,467; 2,431,105; 3,561,805; and 4,163,375. Except for U.S. Pat. No. 4,163,375, the patent disclosures are not suitable for patio door locks, due primarily to their bulk.

In U.S. Pat. No. 4,163,375, two rack and pinion systems, mounted at right angles to one another are used to extend and to retract the bolt. And although a rack and pinion system is ideally suited to provide reciprocating motion of a cylindrical bolt in order to provide a bolt that is free to rotate to inhibit sawing in a forced entry attempt, such a system is unnecessarily complex for the barrel lock assembly drive mechanism. Thus, there exists a need for a small, sturdy, key-operated right-angle lock that provides for maximum security, is easily made, and can be used in essentially every conceivable position while at the same time concealing the means for holding the lock assembly together, and in which the bolt can be locked when extended in either direction, and the barrel lock easily replaced, when necessary or desirable.

SUMMARY OF THE INVENTION

In a push-pull right angle lock according to the present invention, a barrel lock assembly has a keyed barrel lock contained in a longitudinal bore in a cylindrical housing, from which an extension arm depends and which is retained in a two-part longitudinally split case so as to be free to be moved in and out of the case between extended and retracted positions so as to cause a cylindrical bolt within the case to extend outwardly from one side of the case or the other. The bolt, which is mounted at right angles to the barrel lock assembly, can be locked in either of the extended positions by means of a cam at the end of the barrel lock which engages a cam-lug within the housing to extend the lug into appropriate recesses in the case thereby preventing movement of the barrel lock housing and bolt. The ability to extend and lock the bolt in both directions provides for complete flexibility of mounting positions, while at the same time concealing the means for holding the two case sections together. Transfer of the linear motion of the barrel lock assembly to the rectilinear motion of the bolt is accomplished by a rotatable disk with an arcuate segment of a pinion gear which engages circular rack teeth on the bolt. A crank pin on the disk face, displaced approximately 90° from the pinion gear, engages a slot in the extension arm of the barrel lock housing so as to rotate the disk in response to linear movement of the housing.

Two small apertures are provided in the lock case, one of which is aligned with a passageway in the barrel lock housing when the housing is in the extended position and the other when in the retracted position to permit disengagement of a spring-biased retainer leaf on the barrel lock which holds the barrel lock in the cylindrical housing only when the barrel lock is in the unlocked position so that the barrel lock may be removed from the housing and replaced.

BRIEF DESCRIPTION OF THE DRAWINGS

The invention may more readily be understood by referring to the accompanying drawing in which:

FIG. 3 is a right side elevational view of the lock shown in FIG. 1;

FIG. 4 is a plan view of the lock shown in FIG. 1;

FIG. 5 is a sectional view taken along lines 5—5 of FIG. 4;

FIG. 6 is a partial plan view of the lock, similar to FIG. 4, but showing the lock bolt in the opposite disposition from that shown in FIG. 4; and FIG. 7 is an isometric view of the lock housing for the barrel lock of the present invention.

DETAILED DESCRIPTION OF THE PREFERRED EMBODIMENT

Figures 1, 2:
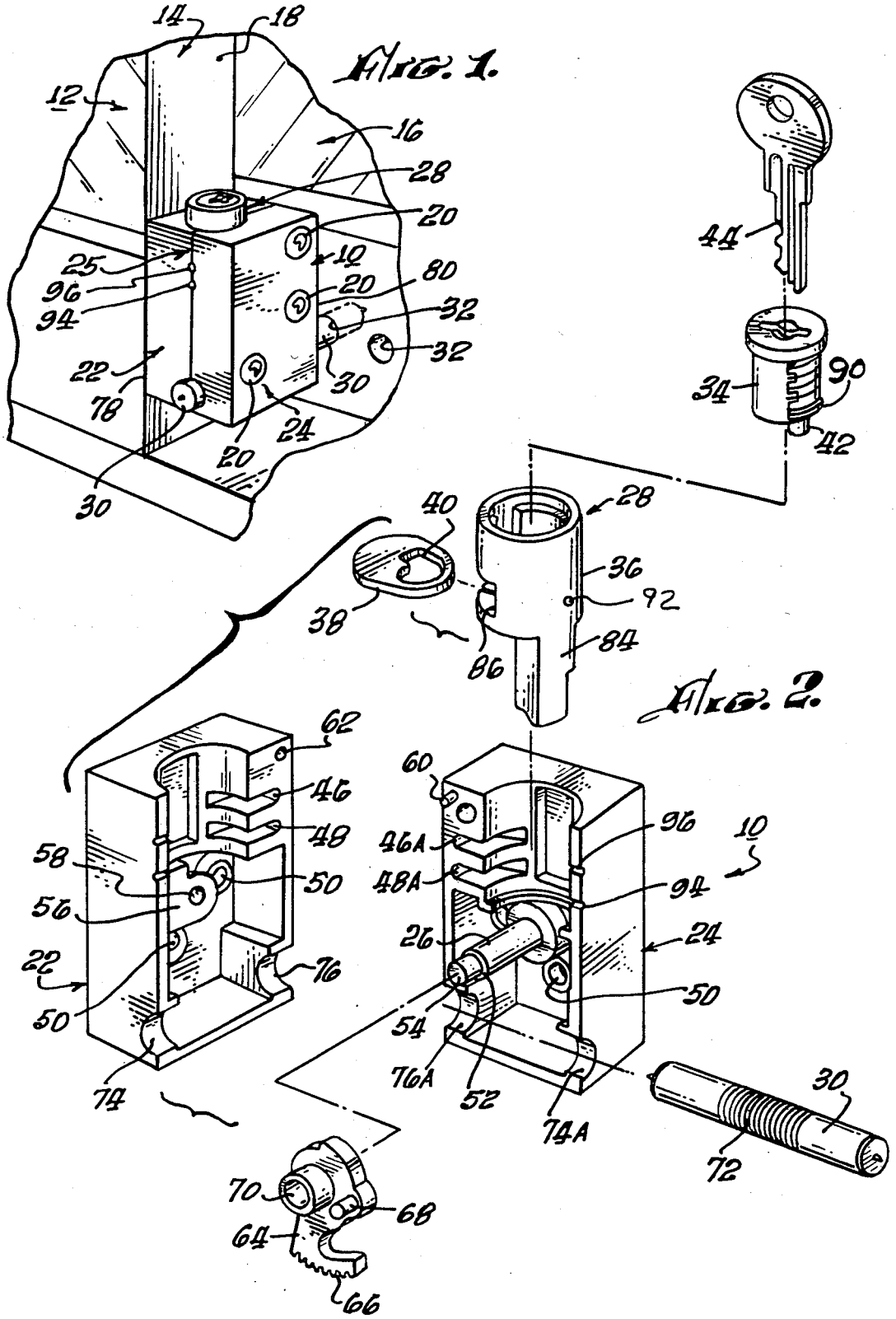
FIG. 1 is an isometric view of the rotary lock of the present invention as installed on a sliding glass door.
FIG. 2 is an exploded view of the lock shown in FIG. 1.

Referring now to FIG. 1, a rotary patio door lock 10, according to the present invention, is mounted on a sliding patio door assembly 12 which consists of an inner door 14 and an outer door 16. Typically, one of the doors 14, 16 is fixed and the other of the doors 14, 16 slides. The door 14 has a frame 18 to which the lock 10 is mounted by three mounting screws 20. The lock 10 has a first body shell member 22 and a second body shell member 24 which are fixed to one another to form a case 25 by expanding a small diameter end-extension 54 of a shaft 26, so as to enclose a barrel lock assembly 28, disk 64 and bolt 30 (see FIG. 2). A locking bolt 30 extends out of the lock 10 on both sides thereof. The door 16 has a plurality of apertures 32 drilled therein into which the bolt 30 may be extended so as to lock the sliding door assembly 12 in the desired position, which may be either completely closed or partially opened to provide ventilation if desired.

FIG. 2 is an exploded view of the rotary lock 10 showing the first and second body shell members 22, 24 separated from one another. The barrel lock assembly 28 is seen to have a barrel lock 34 which is disposed in a barrel lock housing 36 and is locked into the housing 36 by a spring-biased retainer leaf 90. The locking cam lug 38 has an aperture 40 formed thereon into which a cam 42 depending from the barrel lock 34 is disposed. A key 44 is used to rotate the barrel lock 34 within the housing 36 so as to selectively extend or retract the locking cam lug 38 into or out of retaining slots 46, 48 of shell 22 and 46A and 48A of shell 24 when assembled as showin in FIG. 1 to form the case 25.

The body shell members 22, 24 each have three mounting apertures 50 formed therein to receive the three mounting screws 20 which extend through the case 25 to mount the lock 10 to the door frame. The shaft 26 has a shoulder 52 and a smaller diameter tip 54. The first body shell member 22 has a face 56, with a passage 58 formed therein to receive the tip 54 of the shaft 26, so that the shaft shoulder 52 abuts the face 56. The second body shell member 24 has an alignment pin 60 which mates with a cylindrical recess 62 in the first body shell member 22 so as to properly align the body shell members 22, 24 when they are placed together. After being positioned together, the tip 54 is expanded against a shoulder (not shown, see FIG. 3) in the passage 58 to thereby hold the body shell members 22, 24 together to form the unitary case 25 which can not be separated into the shell members 22, 24 without drilling out the expanded tip 54.

A disk 64 is mounted on the shaft 26 so as to be rotatable thereabout. The disk 64 has an arcuate pinion gear section 66 formed thereon so as to be offset approximately 90 degrees from a crank pin 68 extending outwardly from the disk 64 parallel to a bearing aperture 70, through which the shaft 26 extends so as to rotatably mount the disk 64 on the shaft 26.

The bolt 30 has a rack portion 72 formed thereon of circular teeth in the central portion thereof, the bolt 30 being selected to be of a length so as to extend out both sides of the lock 10. As seen in FIG. 2, the bolt 30 is disposed within pairs of semi-circular recesses 74, 76 formed in the first body shell member 22 and complementary recesses 74A, 76A formed in the second body shell member 24.

Referring now to FIG. 3, the rotary patio door lock 10 is shown in left side elevational view, partially broken away, so as to illustrate the attachment of the two body shell members 22, 24 together. The shaft 26 is seen to abut the face 56 and the tip 54 to extend through the passage 58 which opens onto a face—78 of the first body shell member 22 so as to form an enlarged aperture 80. The end of tip 54 has been expanded, shown by 54A, into the enlarged aperture 80, thereby locking the two body shell members 22, 24 together to form the case 25. As shown in FIG. 3, the barrel lock assembly 28 is in its extended position, in which it extends the greatest length beyond the body shell members 22, 24. The barrel lock assembly may be fixed in this disposition by rotating the lock 34 by the key 44, so as to cause the locking cam lug 38 to extend into the first retaining slots—46, 46A.

Referring now to FIG. 4, there is shown a plan view, partially broken away, of the lock 10. In FIG. 4, the lock 10 is locked in its extended barrel lock assembly disposition, thereby locking the bolt 30 in a disposition so as to extend principally out of the right hand side of the lock 10. The bolt 30 is held in this locked disposition by the engagement of the rack portion 72 with the arcuate pinion gear portion 66 of the disk 64, which is fixed against rotation by the combined engagement of the crank pin 68 with an elongated lateral recess 82 formed in a laterally offset extension arm 84 of the barrel housing 36 (see FIG. 7). As will be apparent from FIGS. 3 and 4, the extension arm 84 is laterally offset with respect to the plane of disk 64, the plane of the disk 64 being coplanar with the bolt 30.

In FIG. 6, the lock 10 is shown in its barrel lock assembly retracted disposition. The disk 64 has been rotated clockwise from the disposition shown in FIG. 4, thereby causing the pinion gear portion 66, which engages the rack portion 72 of the bolt 30, to move the bolt 30 to the left, thereby causing the bolt 30 to extend principally out of the left hand side of the lock 10. The clockwise rotation of the disk 64 is caused by forward movement of the barrel housing 36 into the lock case 25 which rotates the crank pin 68 disposed in the elongated lateral recess 82 of the extension arm 84. In FIG. 6, the barrel lock assembly 28 is shown as unlocked in the retracted position, as the locking cam lug 38 does not extend into the second retaining slot 48A. Rotation of the key 44 in a counter-clockwise direction will cause the locking cam lug 38 to be extended out into the slot 48A.

In order to initiate the movement of the barrel lock assembly 28 from the disposition shown in FIG. 4 to the disposition shown in FIG. 6, the key 44 is inserted into the lock and rotated, thereby retracting the locking cam lug 38 into the barrel housing 36, so as to permit the movement of the barrel lock assembly 28 in response to manual pressure by the user.

FIG. 7 is an isometric view of the barrel lock housing 36 which illustrates a slot 86 in which the locking cam lug 38 is disposed (see FIG. 2) so as to be selectively extendable therefrom and retractable therewithin. FIG. 7 also illustrates the depending extension arm 84 and elongated lateral recess 82 which, in cooperation with the crank pin 68, translates the linear longitudinal movement of the barrel lock assembly 28 into linear longitudinal movement of the bolt 30 in a direction normal to the barrel lock assembly movement by means of the bolt rack 72 and arcuate pinion gear 66 of the disk 64.

As will be seen in FIG. 3, the axis of symmetry of the barrel lock assembly 28 lies in the plane of rotation of the arcuate pinion gear 66, but the extension arm 84 is laterally offset therefrom. The arcuate pinion gear 66 and bolt 30 are coplanar with respect to one another, so that the longitudional axis of movement of the barrel lock assembly 28 intersects the longitudional axis of movement of the bolt 30 and is normal thereto.

A particular advantage of the rotary patio door lock of the present invention is that the door lock 10 is either a right hand or a left hand lock. That is, the bolt 30 can be locked in an extended position either extending from the right hand side of the lock 10 or the left hand side of the lock 10 as desired. Thus, the lock 10 can be mounted in either the lower portion of the door, and the key 44 inserted downwardly into the lock 10, or the lock 10 can be mounted "upside-down" in the upper portion of the door, and the key 44 inserted upwardly into the lock 10. In either such mounting, the body shell member 22, through which the expanded tip end 54A is exposed, is placed against the door frame so as to cover the tip 54. In such usage, the screws 20 have unidirectional heads, which prevent unscrewing the screws, so as to remove the lock 10 from the door 12 at the installation. Conventional locks of this type, such as the lock shown in U.S. Pat. No. 4,163,375, are not designed for such use.

A further advantage of the lock 10 with respect to conventional locks is that the barrel lock 34 may be removed from the lock 10 and a new barrel lock substituted therefor. Such a feature is of particular advantage when it is desired to install a plurality of locks 10 in a residence, for example, without the necessity of the user having multiple different keys in order to operate the various locks. In order to provide for such a feature, the barrel lock 34 has a spring biased retainer leaf 90 (see FIG. 2) which is normally biased outwardly to retain the barrel lock 34 in the housing 36 by engaging an inner circumferential groove formed in the housing 36 and which opens into the slot 86, so that both the retainer leaf 90 and locking cam 38 (when retracted) may rotate within the housing 36 upon rotation of the barrel lock 34. The housing 36 has a small passageway 92 (FIG. 6) extending therethrough so as to open onto the retainer leaf 90 when the barrel lock 34 is in its unlocked position. The lock case 25 has a pair of holes 94, 96 formed at the junction of the shells 22, 24 so as to be in alignment with the passageway 92 when the barrel lock 34 is either unlocked or extended. When the lock 34 is in its extended position as shown in FIG. 4, the passageway 92 in the housing 36 is aligned with the case hole 96. When the lock assembly 28 is in the retracted position as shown in FIG. 6, the case hole 94 is in alignment with the passageway 92. In either such alignment, a small rod 98 may be inserted through the respective one of the case holes 94, 96 and the passageway 92 so as to depress the retainer leaf 90 into the barrel lock 34 when and only when the barrel lock 34 is in its unlocked position with cam lug 38 retracted in the barrel lock housing 36, thereby permitting the lock 34 to be withdrawn from the housing 36 by pulling on the key 44. Identically keyed new barrel locks 34 may then be inserted into the desired number of locks 10, so as to provide the identically keyed feature for the user without the necessity of taking the lock 10 apart, which would destroy the lock 10 in view of the expanded end of the tip 54A which holds the two shell members 22, 24 of the case 25 together.

The invention claimed is:

1. A right-angle door lock comprising:

a body case;

a generally cylindrical barrel lock housing contained within said case and including a barrel key operated lock and a locking cam lug;

means for mounting said barrel lock housing in said case so as to be reciprocally slidable within said case along a first axis;

an extension arm on the barrel lock housing, said arm being laterally offset from the longitudinal axis of said housing;

an elongated lateral aperture formed in said arm;

a bolt mounted in said case so as to be reciprocally slidable therein along a second axis normal to the first axis, said barrel lock housing and bolt being mounted in said case so that said first and second axes are intersecting and coplanar;

circular rack means formed on said bolt so as to be disposed within the case;

a rotatable disk mounted in said case and having an arcuate toothed portion in the plane of said axes so as to engage the rack means;

a crank pin extending outwardly from the disk normal thereto, so as to be offset approximately ninety degrees from said arcuate toothed portion and be disposed within an elongated recess in the arm, whereby linear movement of the barrel lock housing into the case causes the arm to move the crank pin to rotate the disk to cause the arcuate toothed portion to rotate in a preselected direction, thereby moving the bolt in a first direction which is normal to the direction of the housing movement, and movement of the barrel lock housing out of the case causes the crank pin to rotate the disk in a direction opposite the preselected direction, thereby moving the bolt in a second direction which is opposite to the first direction.

2. A right-angle door lock comprising:

a split case comprised of two shells, and including means for fastening said shells together, said means being accessible from the exterior of only one of said shells;

a lock housing having a longitudinal bore formed therein and disposed in a longitudinal bore formed in said case between said shells;

a key-operated barrel type lock contained in the lock housing bore;

means for mounting said barrel lock housing in said case bore so as to extend outwardly therefrom and be selectively reciprocally slidable therewithin along a first axis between a retracted position and an extended position;

a bolt mounted in said case so as to be reciprocally slidable therein along a second axis normal to the first axis;

actuating means interconnecting the barrel lock housing and the bolt, whereby movement of the barrel lock housing from the retracted position to the extended position moves the bolt in a first direction to a first extended position, and movement of the barrel lock housing from the extended position to the retracted position moves the bolt in a direction which is opposite to the first direction to a second extended position, said bolt extending from opposite sides of said case in said first and second extended positions; and means for selectively locking said bolt in said first and second extended positions comprising (a) a locking cam lug;

(b) means for mounting said locking cam lug in the barrel lock housing so that the locking cam lug may move normal to the first axis and be selectively extended outwardly from and retracted into said barrel lock housing by rotation of the barrel lock by the key;

(c) a first retaining slot formed in said case bore and adapted to receive said locking cam when the barrel lock housing is in the locked extended position to lock the bolt in said first position; and (d) a second retaining slot formed in said case bore and adapted to receive said locking cam when the barrel lock housing is in the retracted position to lock the barrel lock housing in said second position.

3. A right-angle door lock comprising:

a longitudinally split case comprised of two shells, and including means for fastening said shells together, said means being accessible from the exterior of only one of said shells;

a lock housing having a longitudinal bore formed therein and disposed in a longitudinal bore formed in said case between said shells;

a key-operated barrel type lock contained in the lock housing bore;

means for mounting said barrel lock housing in said case bore so as to extend outwardly therefrom and be selectively reciprocally slidable therewithin along a first axis between a retracted position and an extended position;

a bolt mounted in said case so as to be reciprocally slidable therein along a second axis normal to the first axis;

actuating means interconnecting the barrel lock housing and the bolt, whereby movement of the barrel lock housing from the retracted position to the extended position moves the bolt in a first direction, and movement of the barrel lock housing from the extended position to the retracted position moves the bolt in a direction which is opposite to the first direction;

a locking cam lug;

means for mounting said locking cam lug in the barrel lock housing so that the locking cam lug may move normal to the first axis and be selectively extended outwardly from and retracted into said barrel lock housing by rotation of the barrel lock by the key;

a first retaining slot formed in said case bore and adapted to receive said locking cam when the barrel lock housing is in the extended position to lock the barrel lock housing in said extended position;

a retaining slot formed in said case bore and adapted to receive said locking cam when the barrel lock housing is in the retracted position to lock the barrel lock housing in said retracted position; and in which the barrel type lock has a lock retaining leaf mounted in said barrel and biased so as to extend outwardly laterally therefrom, and the barrel housing bore has means adapted to receive said extended retaining leaf when the barrel is inserted into the lock housing so as to normally retain the barrel in the lock housing while permitting said barrel to be rotated in said barrel housing by the key between locked and unlocked positions, and including a small transverse cylindrical passageway formed in said barrel housing in a disposition so as to open onto said retaining leaf only when the barrel is in the unlocked disposition; and an aperture formed in said case so as to open into the case bore and disposed with respect to the barrel housing passageway so as to provide a linear passageway through the case and the barrel housing to the retaining leaf when the barrel housing is in a preselected position and the barrel lock is unlocked.

4. Apparatus according to claim 3, and in which the preselected barrel housing position corresponds to the barrel housing retracted position.

5. Apparatus according to claim 3, and in which the preselected barrel housing position corresponds to the barrel housing extended position.

6. Apparatus according to claim 5, and including a second aperture formed in said case so as to open into the case bore and disposed with respect to the barrel housing passageway so as to form another linear passageway through the case and the barrel housing to the retaining leaf when the barrel housing is in the retracted position and the barrel lock is unlocked.

* * * * *